US006824238B2

(12) United States Patent
Chang

(10) Patent No.: US 6,824,238 B2
(45) Date of Patent: Nov. 30, 2004

(54) LIQUID JETTING APPARATUS AND METHOD OF DRIVING THE SAME

(75) Inventor: Junhua Chang, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 166 days.

(21) Appl. No.: 09/921,683

(22) Filed: Aug. 6, 2001

(65) Prior Publication Data

US 2002/0024546 A1 Feb. 28, 2002

(30) Foreign Application Priority Data

Aug. 4, 2000 (JP) ..... P.2000-236433
Jul. 16, 2001 (JP) ..... P.2001-214784

(51) Int. Cl.[7] ..... B41J 29/38
(52) U.S. Cl. ..... 347/10; 347/9; 347/11
(58) Field of Search ..... 347/10, 11, 9, 347/68

(56) References Cited

U.S. PATENT DOCUMENTS 6,312,077 B1 * 11/2001 Araki ..... 347/11
6,629,741 B1 * 10/2003 Okuda et al. ..... 347/11

FOREIGN PATENT DOCUMENTS

EP 0947325 A1 10/1999
EP 0963845 A1 * 12/1999
EP 0988974 A2 3/2000
EP 1004441 A2 5/2000
JP 2000-94672 A 4/2000
JP 2000-117969 A 4/2000
JP 2000-141642 A 5/2000
JP 2000-255062 A 9/2000

OTHER PUBLICATIONS

Japanese Patent Office, Office Action issued Apr. 1, 2003.

* cited by examiner

*Primary Examiner*—Hai Pham
*Assistant Examiner*—Lam Nguyen
(74) *Attorney, Agent, or Firm*—Sughrue Mion, PLLC

(57) ABSTRACT

A drive signal generator generates a drive signal including a drive pulse supplied to a pressure generating element. The drive pulse including a first expanding element, which drives the pressure generating element so as to expand a pressure chamber, so that a meniscus of liquid in a nozzle orifice is pulled toward the pressure chamber, a first contracting element, which drives the pressure generating element so as to contract the pressure chamber expanded by the first expanding element, so that a center portion of the meniscus is swelled in an ejecting direction of a liquid drop, and a second expanding element, which drives the pressure generating element so as to expand the pressure chamber contracted by the first contracting element, so that a marginal portion of the swelled center portion of the meniscus is pulled toward the pressure chamber. The first expanding element is supplied for a time period which is not greater than a half a natural vibration period of the pressure chamber. A potential difference of the first contracting element being not greater than 60% of a potential difference between a minimum potential and a maximum potential of the drive signal.

20 Claims, 10 Drawing Sheets

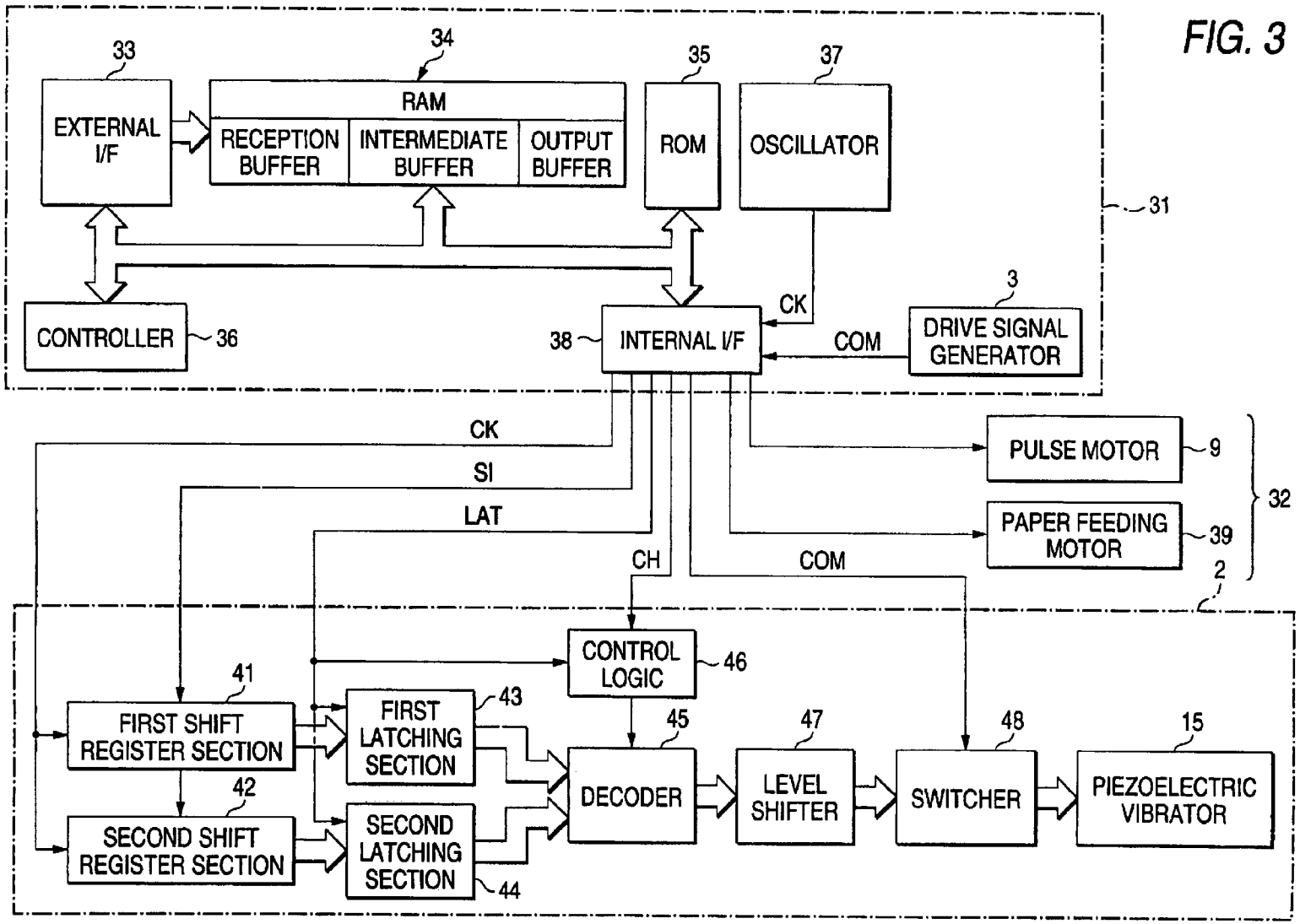
FIG. 3
31
32
2
9
39
15
PULSE MOTOR
PAPER FEEDING MOTOR
PIEZOELECTRIC VIBRATOR
3
DRIVE SIGNAL GENERATOR
48
SWITCHER
37
OSCILLATOR
COM
CK
COM
47
LEVEL SHIFTER
35
ROM
INTERNAL I/F
46
CONTROL LOGIC
45
DECODER
CH
38
OUTPUT BUFFER
INTERMEDIATE BUFFER
RECEPTION BUFFER
RAM
34
CK
SI
LAT
43
FIRST LATCHING SECTION
SECOND LATCHING SECTION
44
41
FIRST SHIFT REGISTER SECTION
42
SECOND SHIFT REGISTER SECTION
36
CONTROLLER
33
EXTERNAL I/F

LIQUID JETTING APPARATUS AND METHOD OF DRIVING THE SAME

BACKGROUND OF THE INVENTION

This invention relates to a liquid jetting apparatus such as an ink jet recording apparatus and a method of driving the same. Particularly, it relates to a liquid jetting apparatus for ejecting an extremely small amount of liquid droplet.

A related art will be discussed by taking an example an ink jet printer (a kind of ink jet recording apparatus), one form of a liquid jetting apparatus.

In the printer, the size of each dot on recording paper, namely, resolution is determined by the amount of ink droplet (a kind of liquid droplet) ejected through an ink jet recording head. Thus, it becomes important to control the ejecting amount of ink droplets. To make an attempt to control the ejecting amount by changing the caliber of a nozzle orifice, if the caliber is made small, the resolution is improved, but the recording speed becomes low; if the caliber is made large, the recording speed is increased, but a coarse image with a low resolution is formed. To satisfy such mutually contradictory requirements, the caliber of a nozzle orifice is sized large to deal with a large ink drop, and a waveform of a drive signal, namely, the way of driving the recording head, is devised so as to eject different amounts of ink droplets through the same nozzle orifice.

By the way, the improvement in image quality has been demanded for a recent ink jet printer. Thus, the waveform of a signal supplied to a piezoelectric vibrator for changing the volume of a pressure chamber is devised so as to eject an extremely small amount of ink droplet.

When an ink droplet is ejected, it is known that the ink droplet is separated into a main ink droplet and a satellite ink droplet associated with the main ink droplet. In an extremely small amount of ink droplet of about 4 pL (picoliters), the main ink droplet and the satellite ink droplet are of almost the same volume and each an amount of about 2 pL. A time lag exists between landing of the main ink droplet and the satellite ink droplet land on a recording medium. Namely, after the main ink droplet has landed on the recording medium, the satellite ink droplet lands thereon. Further, the jetting speed of the satellite ink droplet is lower than that of the main ink droplet. For example, the jetting speed of the main ink droplet is 7 to 8 m/s; while that of the satellite ink droplet is 3 to 4 m/s. Since the recoding head ejects the ink droplets while moving, there is probability that the landing position of the main ink droplet may shift largely from that of the satellite ink droplet.

SUMMARY OF THE INVENTION

It is therefore an object of the invention to eject an extremely small amount of droplet while decreasing the jetting speed difference between a main droplet and a satellite droplet.

In order to achieve the above object, according to the present invention, there is provided a liquid jetting apparatus, comprising:

a liquid jetting head, including a nozzle orifice, a pressure chamber communicated with the nozzle orifice, and a pressure generating element which varies the volume of the pressure chamber; and a drive signal generator, which generates a drive signal including a drive pulse supplied to the pressure generating element, the drive pulse including:

a first expanding element, which drives the pressure generating element so as to expand the pressure chamber, so that a meniscus of liquid in the nozzle orifice is pulled toward the pressure chamber, the first expanding element being supplied for a time period which is not greater than a half a natural vibration period of the pressure chamber;

a first contracting element, which drives the pressure generating element so as to contract the pressure chamber expanded by the first expanding element, so that a center portion of the meniscus is swelled in an ejecting direction of a liquid drop, a potential difference of the first contracting element being not greater than 60% of a potential difference between a minimum potential and a maximum potential of the drive signal; and a second expanding element, which drives the pressure generating element so as to expand the pressure chamber contracted by the first contracting element, so that a marginal portion of the swelled center portion of the meniscus is pulled toward the pressure chamber.

In this configuration, the amount of a liquid pillar generated in the center of the meniscus with supply of the first expanding element, the first contracting element, and the second expanding element can be extremely lessened, so that the ejected droplet amount can be decreased.

Further, since the supplying time period of the first expanding element is not greater than one half the natural vibration period of the pressure chamber for largely pulling in the meniscus, reaction of the pulled meniscus can be used so that desired pressure can be obtained even though the potential difference of the first contracting element is small (namely, with low voltage). Accordingly, since loads on the pressure generating element can be reduced, stable ejecting of a droplet and prolonging the life of the pressure generating element can be attained.

Preferably, a potential difference of the first expanding element is equal to the potential difference of the drive signal.

Preferably, the potential difference of the first contracting element is not greater than 50% of the potential the drive signal. Here, a potential difference of the second expanding element is not less than 40% of the potential difference of the drive signal.

Here, it is preferable that the potential difference of the second expanding element is not greater than the potential difference of the first contracting element.

Preferably, the second expanding element is supplied for a time period which is not greater than one quarter the natural vibration period of the pressure chamber.

Preferably, a gradient of the second expanding element is greater than a gradient of the first contracting element.

Preferably, the drive pulse includes a contracted state holding element, which connects the first contracting element and the second expanding element such that a termination end of the first contracting element and a start end of the second expanding element have an identical potential.

Here, the contracted state holding element is supplied for a time period which is not greater than one quarter the natural vibration period of the pressure chamber.

Preferably, the drive pulse includes a second contracting element, which drives the pressure generating element so as to contract the pressure chamber expanded by the second expanding element.

In this configuration, the meniscus moves in the ejecting direction as the second contracting element is supplied, and thus the liquid pillar is pushed from the root portion thereof. Thus, when the ink pillar is torn off and is separated into a main droplet and a satellite droplet to be jetted, the satellite droplet is urged by the meniscus so that the jetting speed of the satellite droplet can be increased. Consequently, the landing position of the main droplet can be matched with that of the satellite droplet.

Further, since the potential difference of the first contracting element is not greater than 60% of the potential difference of the drive signal, the termination potential of the second expanding element, which is the start end potential of the second contracting element, can be easily brought close to the termination potential of the first expanding element. Accordingly, the potential difference of the second contracting element can be easily enlarged. Consequently, the speed of the satellite droplet can be adjusted in a wide range without enlarging the potential difference of the drive signal.

Here, it is preferable that a potential difference of the second contracting element is not less than 75% of the potential difference of the drive signal.

In this configuration, the landing position of the main droplet and that of the satellite droplet can be brought closer to each other and the image quality can be further improved.

Here, it is preferable that the second contracting element is supplied for a time period which is not greater than one third of the natural vibration period of the pressure chamber.

Here, it is preferable that a time period from a start end of the first contracting element to a start end of the second contracting element is not greater than the natural vibration period of the pressure chamber.

Further, it is preferable that the time period between the start ends of the first contracting element and the second contracting element falls within a range of one quarter to one third of the natural vibration period of the pressure chamber.

Here, it is preferable that the drive pulse includes: a damping hold element, which holds a termination end potential of the second contracting element for a predetermined time period; and a damping element, supplied after the damping holding element to drive the pressure generating element so as to expand the pressure chamber to a reference volume thereof.

Further, it is preferable that the damping element is supplied for a time period which is not greater than a half the natural vibration period of the pressure chamber.

Still further, it is preferable that a time period from a start end of the first contacting element to a start end of the damping element is not greater than the natural vibration period of the pressure chamber.

Preferably, the drive pulse includes a preliminary contracting element, which drives the pressure generating element so as to contract the pressure chamber from a reference volume thereof, before the first expanding element is supplied.

According to the present invention, there is also provided a method of driving a liquid jetting apparatus provided with a liquid jetting head which includes a nozzle orifice, a pressure chamber communicated with the nozzle orifice, and a pressure generating element, the method comprising the steps of:

a first expanding step, for driving the pressure generating element so as to expand the pressure chamber, so that a meniscus of liquid in the nozzle orifice is pulled toward the pressure chamber as much as possible;

a first contracting step, for driving the pressure generating element so as to contract the pressure chamber expanded by the first expanding step, so that a center portion of the meniscus is swelled in an ejecting direction of a liquid drop;

a second expanding step, for driving the pressure generating element so as to expand the pressure chamber contracted by the first contracting step, so that a marginal portion of the swelled center portion of the meniscus is pulled toward the pressure chamber; and a second contracting step, for driving the pressure generating element so as to contract the pressure chamber expanded by the second expanding step, so that the meniscus is again urged in the ejecting direction to increase jetting speed of a satellite liquid drop which follows a main liquid drop.

Preferably, the first expanding step is performed for a time period which is not greater than a half a natural vibration period of the pressure chamber.

Preferably, the second contracting step is performed for a time period which is not greater than one third of a natural vibration period of the pressure chamber.

Preferably, a time period between a time at which the first contracting step is started and a time at which the second contracting step is started is not greater than a natural vibration period of the pressure chamber.

Here, it is preferable that the time period between the start timings of the first contracting step and the second contracting step falls within a range of one quarter to one third the natural vibration period of the pressure chamber.

The invention can be embodied in various modes of a print method, a print apparatus, or the like.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein:

FIG. 3 is a block diagram to describe the electric configuration of the ink jet printer;

DETAILED DESCRIPTION OF THE PREFERRED EMBODIMENTS

Figure 1:
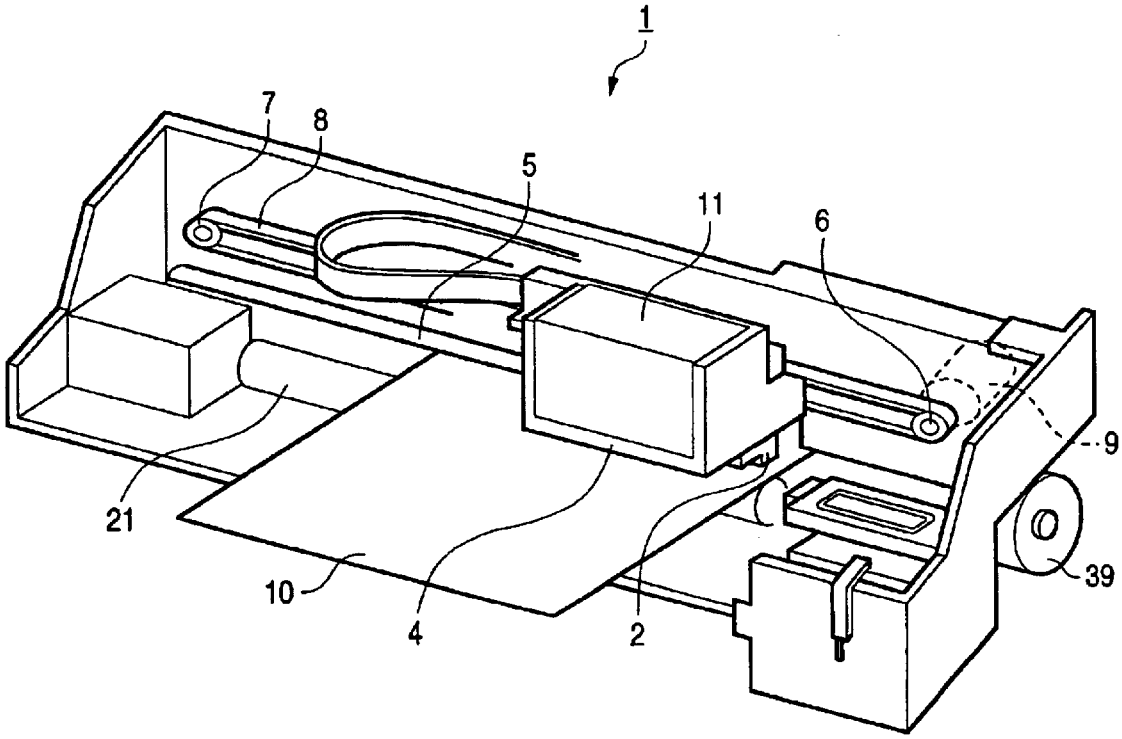
FIG. 1 is a perspective view of an ink jet printer.

Referring now to the accompanying drawings, there is shown a preferred embodiment of the invention. In the description that follows, as a liquid jetting apparatus, an ink jet printer (simply, printer) is taken as an example.

The ink jet printer 1 comprises a carriage 4 attached movably to a guide member 5. The carriage 4 is connected to a timing belt 8 placed on a drive pulley 6 and an idle pulley 7. Since the drive pulley 6 is joined to a rotation shaft of a pulse motor 9, the carriage 4 is moved in a main scanning direction of a width direction of recording paper 10 (a kind of recording medium) as the pulse motor 9 is driven. The recording head 2 is attached to the face of the carriage 4 opposed to the recording paper 10.

Figure 2:
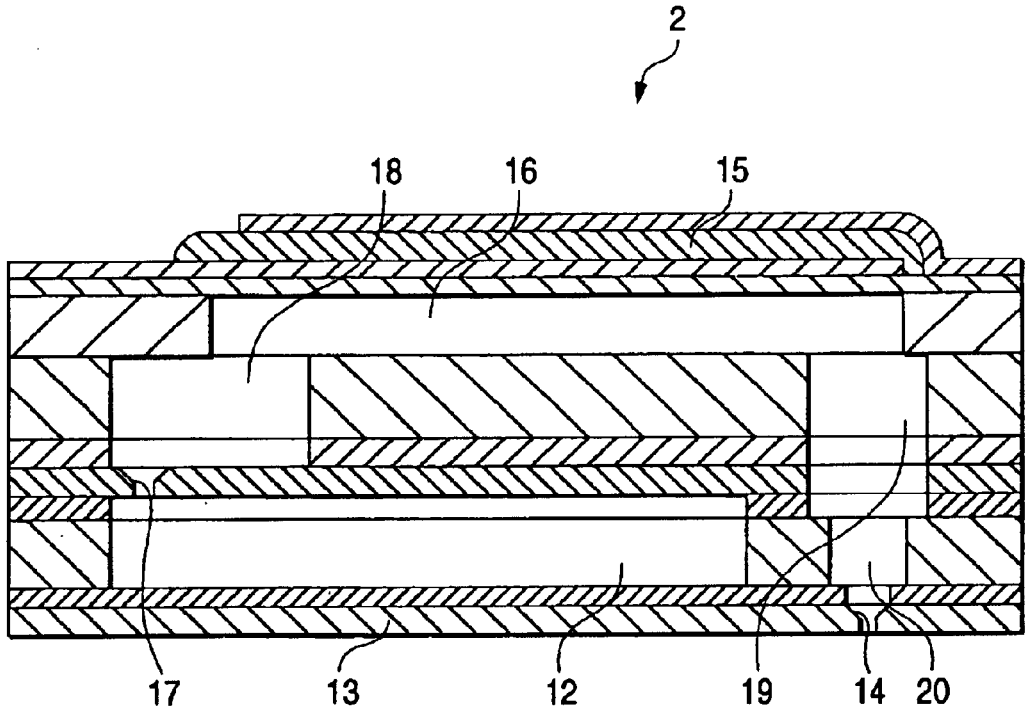
FIG. 2 is a sectional view to show an ink jet recording head.

As shown in FIG. 2, the recording head 2 comprises a common ink reservoir 12 to which ink is supplied from an ink cartridge 11 (see FIG. 1), a plurality of (for example, 64) nozzle orifices 14 formed in a nozzle plate and arranged in a subscanning direction, and a plurality of pressure chambers 16 provided in a one-to-one correspondence with the nozzle orifices 14. Each pressure chamber 16 has a volume changed as it is expanded or contracted with deformation of a piezoelectric vibrator 15 corresponding to the pressure chamber 16. The common ink reservoir 12 and the pressure chamber 16 are made to communicate with each other through an ink supply port 17 and a supply side communication hole 18, and each pressure chamber 16 and each nozzle orifice 14 are made to communication with each other through a first nozzle communication port 19 and a second nozzle communication port 20. That is, the ink flow passage from the common ink reservoir 12 through the pressure chamber 16 to the nozzle orifice 14 is formed for each nozzle orifice 14.

The above-mentioned piezoelectric vibrator 15 is a kind of pressure generating element of the invention; in the embodiment, a piezoelectric vibrator in so-called deflection vibration mode is used. As the piezoelectric vibrator 15 is charged, it is deflected in a direction orthogonal to an electric field so that the pressure chamber 16 is contracted. If the charged piezoelectric vibrator 15 is discharged, it is deflected in the direction orthogonal to the electric field so that the pressure chamber 16 is expanded.

Therefore, in the recording head 2, as the piezoelectric vibrator 15 is charged or discharged, the volume of the corresponding pressure chamber 16 is changed. As the volume of the pressure chamber 16 is changed, ink in the pressure chamber is pressurized or decompressed and pressure fluctuation occurs. The ink pressure fluctuation can be used to eject an ink droplet through the nozzle orifice 14.

Thus, in the recording head 2, pressure fluctuation in ink in the pressure chamber 16 is caused to occur. A pressure wave behaving as if the inside of the pressure chamber were an acoustic pipe occurs in ink with the pressure fluctuation. The pressure wave reciprocates in a natural vibration period Tc of the pressure chamber 16.

The natural vibration period Tc can be calculated based on an equivalent circuit determined using as parameters, inertia indicating the mass of a medium per unit length, compliance indicating volume change per unit pressure, resistance indicating the internal loss of medium, pressure generated by the piezoelectric vibrator 15, volume speed of the piezoelectric vibrator 15, ink, etc., and the like. With the recording head 2 of the embodiment, the calculated natural vibration period Tc is about 10 $\mu$sec.

In the described printer 1, at the record operation time, dye ink, pigment ink, etc., is ejected in an ink droplet form from the recording head 2 in synchronization with a move of the carriage 4 in the main scanning direction. A paper feeding roller 21 is rotated in association with reciprocating of the carriage 4 for moving recording paper 10 in a paper feed direction. That is, subscanning is executed. Consequently, an image, text, etc., based on print data is recorded on the recording paper 10.

Next, the electric configuration of the printer 1 will be discussed. As shown in FIG. 3, the printer 1 comprises a printer controller 31 and a print engine 32.

The printer controller 31 comprises an interface 33 (external I/F 33) for receiving print data, etc., from a host computer (not shown), etc., a RAM (Random Access Memory) 34 for storing various pieces of data, etc., a ROM (Read Only Memory) 35 storing routines for various types of data processing, etc., a controller 36 implemented as a CPU, etc., an oscillator 37 for generating a clock signal (CK), a drive signal generator 3 for generating a drive signal (COM) supplied to the recording head 2, and an interface 38 (internal I/F 38) for transmitting recording data (SI) expanded into dot pattern data, drive signal, etc., to the print engine 32.

The external I/F 33 receives print data consisting of one or more of character code, graphics function, and image data, for example, from the host computer, etc. It also outputs a busy signal (BUSY), an acknowledge signal (ACK), etc., to the host computer.

The RAM 34 is used as a reception buffer, an intermediate buffer, an output buffer, work memory (not shown), and the like. The print data received at the external I/F 33 from the host computer is temporarily stored in the reception buffer. Intermediate code data provided as intermediate code by the controller 36 is stored in the intermediate buffer. The intermediate code is converted into recording data for each dot in the output buffer. The ROM 35 stores various control routines executed by the controller 36, font data, graphics functions, various procedures, etc.

The controller 36 reads the print data in the reception buffer, converts the print data into intermediate code, and stores the intermediate code data in the intermediate buffer. It also analyzes the intermediate code data read from the intermediate buffer, references the font data, graphics functions, etc., in the ROM 35, and converts the intermediate code data into the recording data for each dot. The recording data is two-bit gradation information, for example.

The provided recording data is stored in the output buffer and when recording data equivalent to one line of the recording head 2 is provided, the one-line recording data (SI) is transmitted in series through the internal I/F 38 to the recording head 2. When the one-line recording data is transmitted from the output buffer, the contents of the intermediate buffer are erased and the next recording data in the reception buffer is converted into intermediate code.

The controller 36 forms a part of a timing signal generator, and supplies a latch signal (LAT) and a channel signal (CH) to the recording head 2 through the internal I/F 38. The latch signal and the channel signal define the supply start timing of each of pulse signals making up a drive signal (described later).

The drive signal generator 3 is a kind of drive signal generator in the invention and generates a drive signal sequence containing drive pulses each made up of a plurality of waveform elements. The drive signal will be discussed later.

The print engine 32 is made up of an electric drive system of the recording head 2, the above-mentioned pulse motor 9 for moving the carriage 4, a paper feeding motor 39 for rotating the paper feeding roller 21, and the like.

The electric drive system of the recording head 2 comprises a first shift register section 41, a second shift register section 42, a first latching section 43, a second latching section 44, a decoder 45, a control logic 46, a level shifter 47, a switcher 48, and the piezoelectric vibrator 15.

Figure 4:
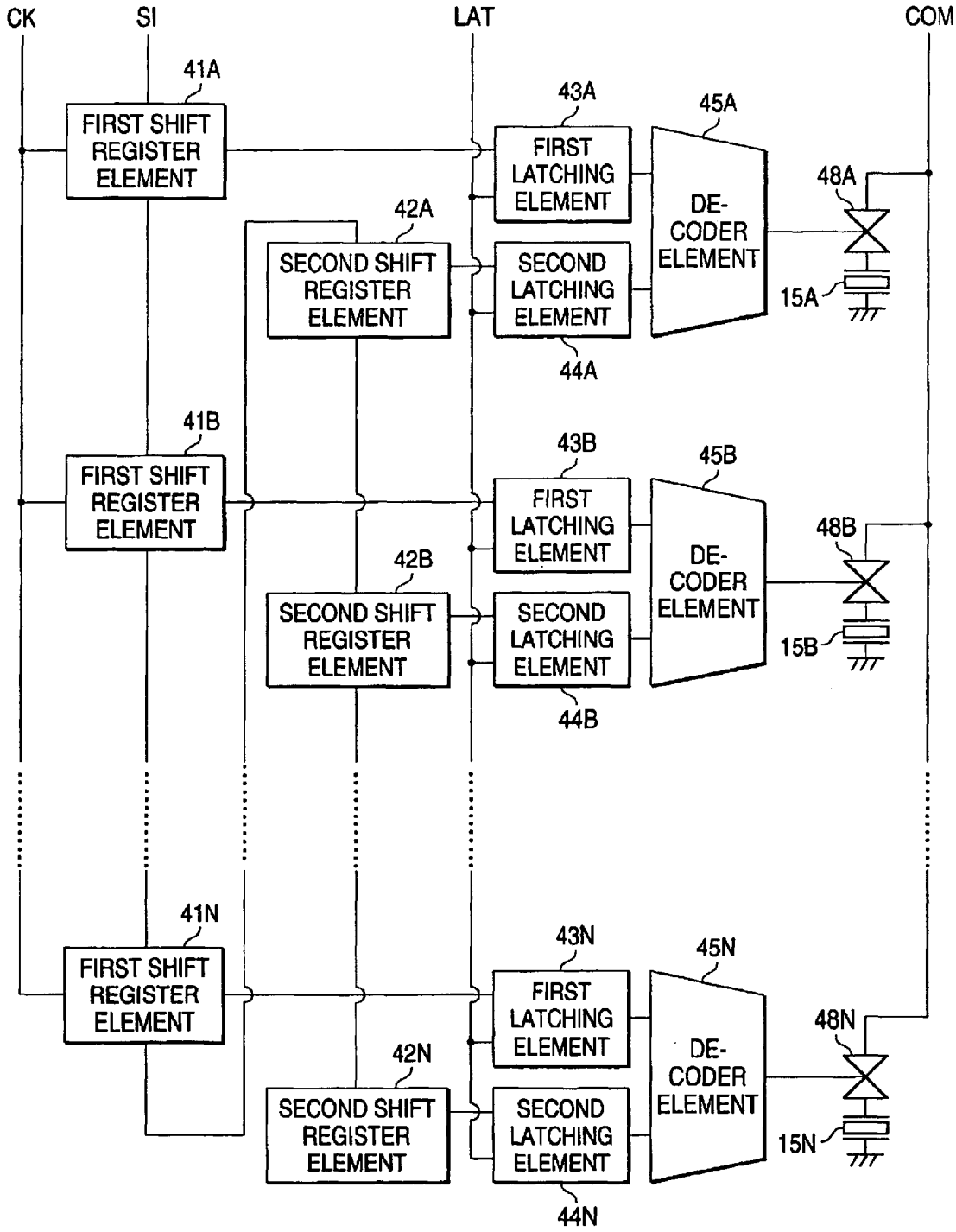
FIG. 4 is a block diagram to describe an electric drive system of the ink jet recording head.

The first shift register section 41, the second shift register section 42, the first latching section 43, the second latching section 44, the decoders 45, the switcher 48, and the piezoelectric vibrator 15 are provided in association with each nozzle orifice 14 of the recording head 2. For example, as shown in FIG. 4, they may be first shift register elements 41A to 41N, second shift register elements 42A to 42N, first latching elements 43A to 43N, second latching elements 44A to 44N, decoder elements 45A to 45N, switch elements 48A to 48N, and piezoelectric vibrators 15A to 15N. The recording head 2 ejects an ink droplet based on recording data (gradation information) from the printer controller 31.

That is, the recording data (SI) from the printer controller 31 is transmitted in series from the internal I/F 38 to the first shift register section 41 and the second shift register section 42 in synchronization with a clock signal (CK) from the oscillator 37. The recording data from the printer controller 31 is two-bit data as mentioned above and represents four gradation steps consisting of non-recording, a small dot recording, a medium dot recording, and a large dot recording. In the embodiment, the non-recording corresponds to gradation information (00), the small dot recording corresponds to gradation information (01), the medium dot recording corresponds to gradation information (10), and the large dot recording corresponds to gradation information (11).

The recording data is set for each dot, namely, for each nozzle orifice 14. The low-order bit (bit 0) concerning each of the nozzle orifices 14 is input to the first shift register section 41 corresponding to the nozzle orifice 14 and the high-order bit (bit 1) concerning each of the nozzle orifices 14 is input to the second shift register section 42 corresponding to the nozzle orifice 14. The first latching section 43 is electrically connected to the first shift register section 41 and the second latching section 44 is electrically connected to the second shift register section 42. When a latch signal (LAT) from the printer controller 31 is input to the first and second latching sections 43 and 44, the first latching section 43 latches the low-order bit data of the recording data and the second latching section 44 latches the high-order bit of the recording data. A pair of the first shift register section 41 and the first latching section 43 and a pair of the second shift register section 42 and the second latching section 44 performing such operation constitute a memory for temporarily storing the recording data before input to the corresponding decoder 45.

The recording data latched in the first and second latching sections 43 and 44 is input to the corresponding decoder 45, which serves as a translator for translating the two-bit recording data to generate pulse selection data. The pulse selection data is made up of a plurality of bits, each corresponding to each of pulse signals making up a drive signal (COM). Supply or non-supply of the pulse signal to the piezoelectric vibrator 15 is selected in response to the contents of each bit (for example, "0" or "1"). Supply control of the pulse signal will be discussed later.

A timing signal from the control logic 46 is also input to the decoder 45. The control logic 46 serves as the timing signal generator together with the controller 36 and generates a timing signal whenever a latch signal (LAT) and a channel signal (CH) are received.

The pulse selection data generated by the decoder 45 is input to the level shifter 47 in order starting at the low-order bit each time the timing defined by the timing signal comes. For example, the most significant bit data of the pulse selection data is input to the level shifter 47 at the first timing in a unit recording period and the second most significant bit data of the pulse selection data is input to the level shifter 47 at the second timing.

The level shifter 47 serves as a voltage amplifier. If the pulse selection data is "1," the level shifter 47 outputs an electric signal boosted to a voltage capable of driving the switcher 48, for example, a voltage of about several ten volts. The pulse selection data of "1" boosted by the level shifter 47 is supplied to the switcher 48.

The switcher 48 selectively supplies a drive pulse contained in a drive signal to the piezoelectric vibrator 15 based on the pulse selection data. The switcher 48 has an input side terminal to which the drive signal (COM) from the drive signal generator 3 is supplied and an output side terminal to which the piezoelectric vibrator 15 is connected.

The pulse selection data controls the operation of the switcher 48. For example, while the pulse selection data applied to the switcher 48 is "1," the switcher 48 enters a connection state, a drive signal is supplied to the piezoelectric vibrator 15, and the potential level of the piezoelectric vibrator 15 changes in response to the drive signal. On the other hand, while the pulse selection data applied to the switcher 48 is "0," the level shifter 47 does not output an electric signal for operating the switcher 48. Thus, the switcher 48 enters a disconnection state and no drive signal is supplied to the piezoelectric vibrator 15.

Since the piezoelectric vibrator 15 behaves like a capacitor, the piezoelectric vibrator 15 while the pulse selection data is "0" is maintained at the potential level just before the pulse selection data is switched to "0."

As seen from the description given above, the controller 36, the first and second shift register sections 41 and 42, the first and second latching sections 43 and 44, the decoder 45, the control logic 46, the level shifter 47, and the switcher 48 serve as a pulse supplier for selecting a necessary pulse signal from a drive signal and supplying the selected pulse signal to the corresponding piezoelectric vibrator 15.

Figure 5:
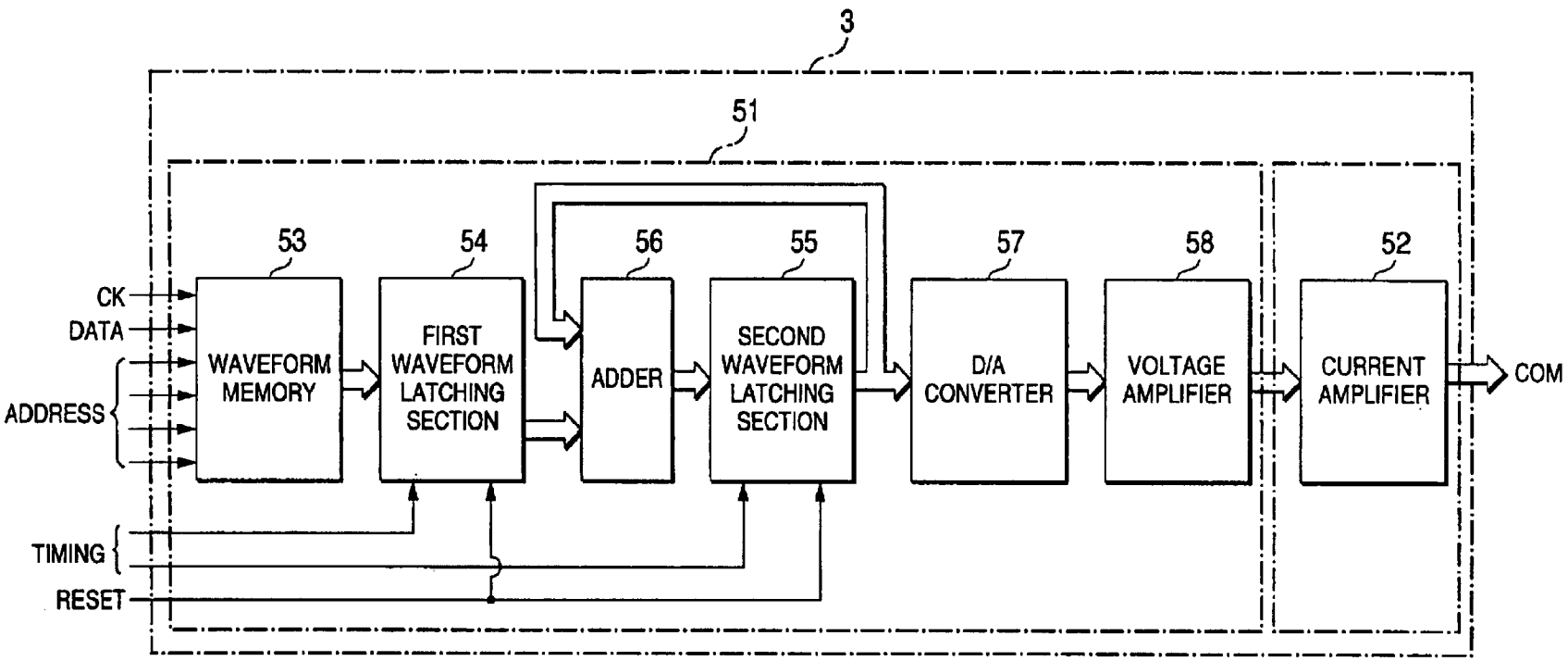
FIG. 5 is a block diagram to describe the configuration of a drive signal generator.

Next, the drive signal generator 3 will be discussed. As shown in FIG. 5, the drive signal generator 3 comprises a waveform generator 51 and a current amplifier 52.

The waveform generator 51 comprises a waveform memory 53, a first waveform latching section 54, a second waveform latching section 55, an adder 56, a digital-analog (D/A) converter 57, and a voltage amplifier 58.

The waveform memory 53 serves as a voltage variation data memory for separately storing different types of voltage variation data pieces output from the controller 36. The first waveform latching section 54 is electrically connected to the waveform memory 53. The first waveform latching section 54 holds voltage variation data stored at a predetermined address of the waveform memory 53 in synchronization with a first timing signal. Output of the first waveform latching section 54 and output of the second waveform latching section 55 are input to the adder 56, and the second waveform latching section 55 is electrically connected to the output side of the adder 56. The adder 56 adds output signals together and outputting the result thereof.

The second waveform latching section 55 is an output data holder for holding data (voltage information) output from the adder 56 in synchronization with a second timing signal. The D/A converter 57 is electrically connected to the output side of the second waveform latching section 55 and converts an output signal held by the second waveform latching section 55 into an analog signal. The voltage amplifier 58 is electrically connected to the output side of the D/A converter 57 and amplifies the analog signal provided by the D/A converter 57 to the voltage of a drive signal.

The current amplifier 52 is electrically connected to the output side of the voltage amplifier 58 and amplifies the electric current of the signal whose voltage is amplified by the voltage amplifier 58 and outputs the result as a drive signal (COM).

Before generating a drive signal, the described drive signal generator 3 separately stores a plurality of voltage variation data pieces in predetermined locations in the waveform memory 53. For example, the controller 36 outputs voltage variation data and the address data corresponding thereto to the waveform memory 53, which then stores the voltage variation data in the location addressed by the address data. The voltage variation data is implemented as data containing positive or negative information (increment or decrement information) and the address data is implemented as a four-bit address signal.

When different types of voltage variation data pieces are thus stored in the waveform memory 53, it is made possible to generate a drive signal. To generate a drive signal, the voltage variation data is set in the first waveform latching section 54 and is then added to the output voltage from the second waveform latching section 55 every predetermined update period.

Figure 7:
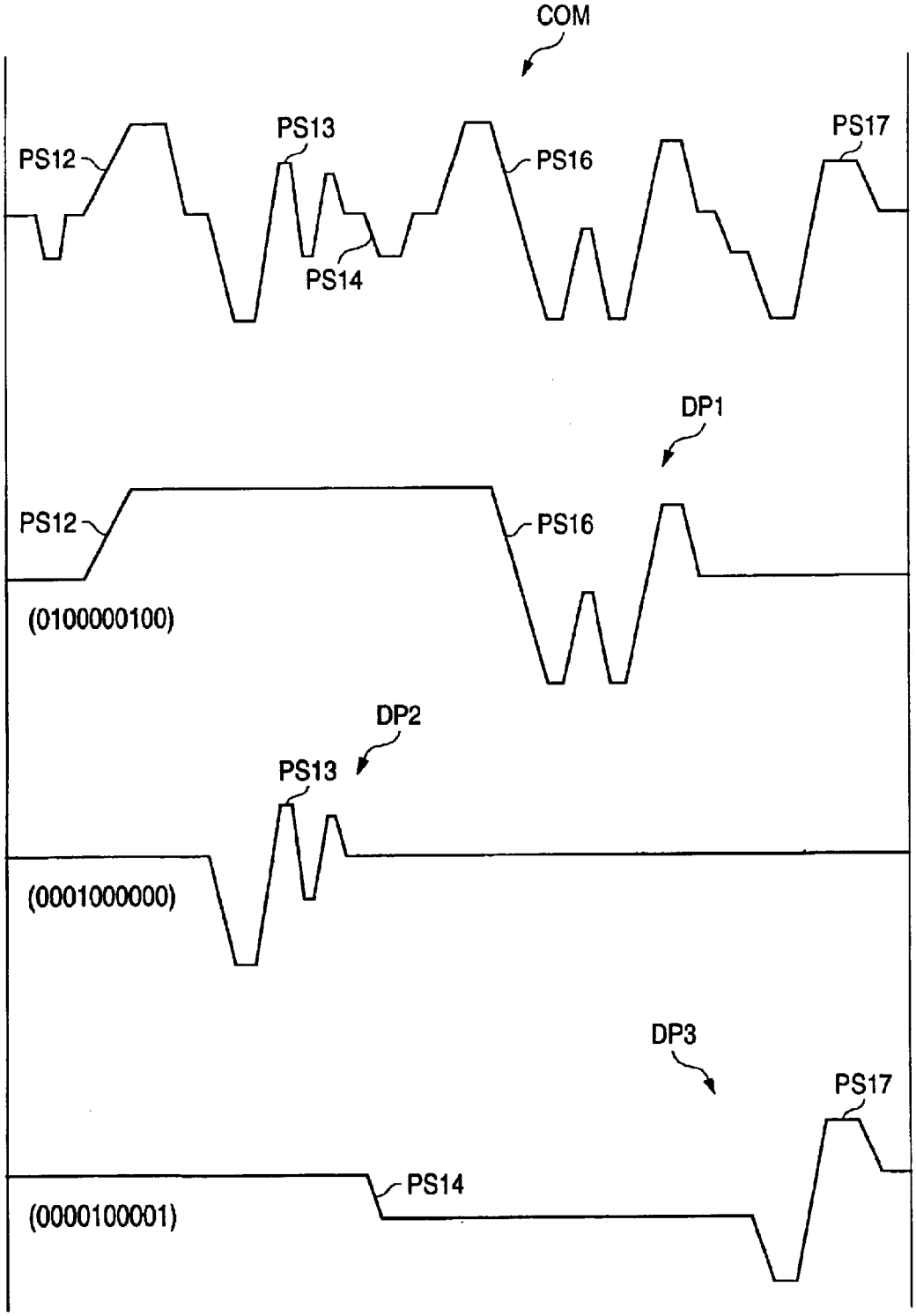
FIG. 7 is a drawing to describe drive pulses in the drive signal.

Next, the drive signal (COM) generated by the drive signal generator 3 will be discussed. The drive signal generated by the drive signal generator 3 is a signal sequence containing a plurality of types of drive pulses different in ejected ink amount. For example, as shown in FIG. 7, the drive signal COM is made up of signals containing a small dot drive pulse DP1 for ejecting an extremely small amount of ink droplet corresponding to a small dot, a medium dot drive pulse DP2 for ejecting a small amount of ink droplet corresponding to a medium dot, and a large dot drive pulse DP3 for ejecting an amount of ink droplet corresponding to a large dot. Further, each drive pulse is made up of a plurality of waveform elements.

Figure 6:
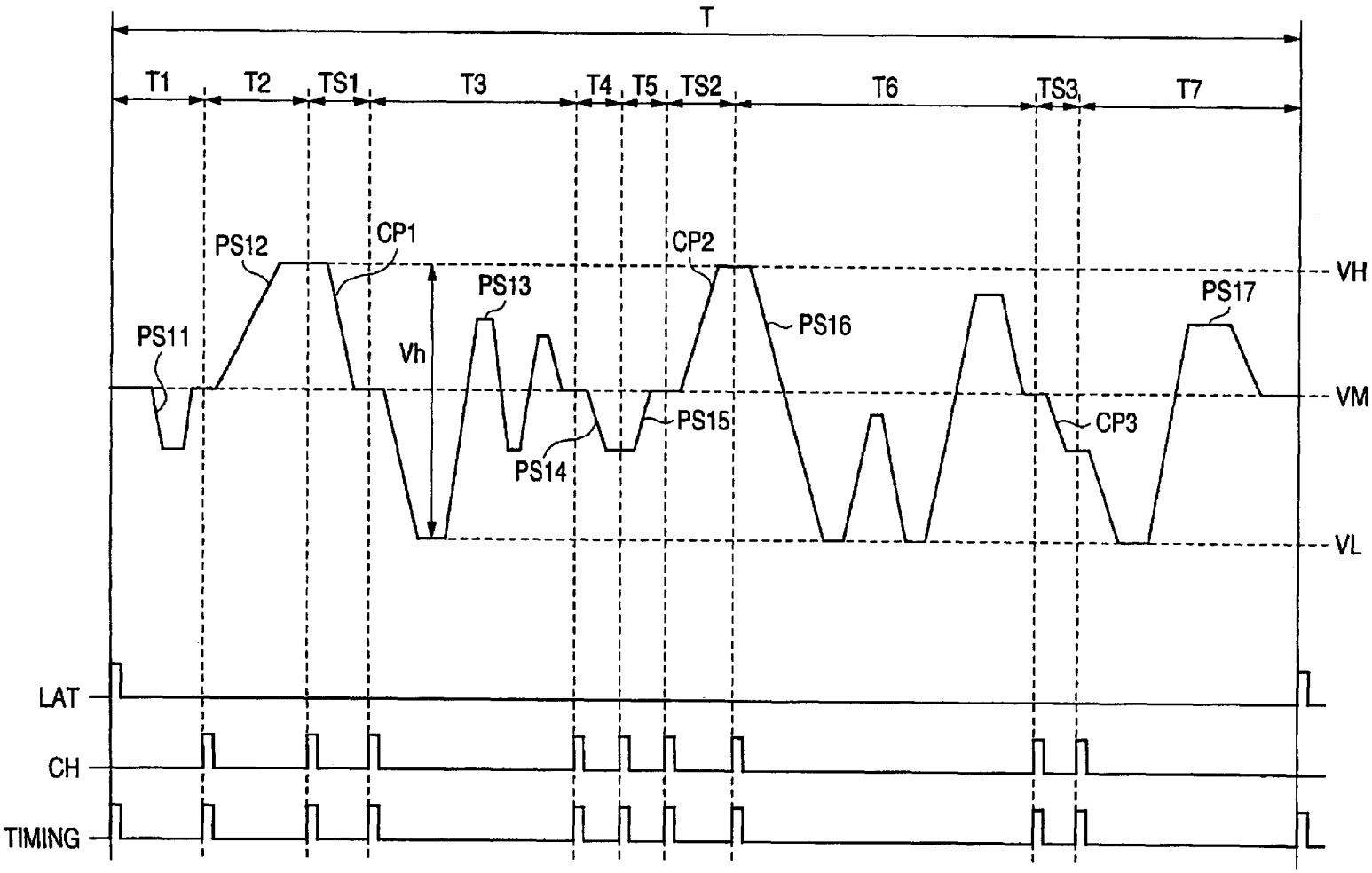
FIG. 6 is a drawing to show a drive signal.

As shown in FIG. 6, the drive signal contains a first pulse signal PS11 generated at time T1, a second pulse signal PS12 generated at time T2, a third pulse signal PS13 generated at time T3, a fourth pulse signal PS14 generated at time T4, a fifth pulse signal PS15 generated at time T5, a sixth pulse signal PS16 generated at time T6, a seventh pulse signal PS17 generated at time T7, a first connection element CP1 generated at time TS1, a second connection element CP2 generated at time TS2, and a third connection element CP3 generated at time TS3; the drive signal is repeatedly generated in a print period T. Drive voltage Vh of the drive signal is the potential difference between highest potential VH (for example, 36 V) and lowest potential VL (for example, GND potential). The connection elements CP1, CP2, and CP3 are each a waveform element for connecting different potential levels of pulse signals generated preceding and following the waveform element, and are not supplied to the piezoelectric element 15.

In the illustrated drive signal, the first pulse signal PS11 is a vibrating pulse for vibrating meniscus of ink in the nozzle orifice so as not to eject an ink droplet therefrom. The second pulse signal PS12 is a signal forming a part of the small dot drive pulse DP1. The third pulse signal PS13 is a signal forming the medium dot drive pulse DP2. The fourth pulse signal PS14 is a signal forming a part of the large dot drive pulse DP3 or forming a part of the vibrating pulse. The fifth pulse signal PS15 is a signal being paired with the fourth pulse signal PS14 for forming the vibrating pulse. The sixth pulse signal PS16 is a signal being paired with the second pulse signal PS12 for forming the small dot drive pulse DP1. The seventh pulse signal PS17 is a signal being paired with the fourth pulse signal PS14 for forming the large dot drive pulse DP3.

As shown in FIG. 7, the second pulse signal PS12 and the sixth pulse signal PS16 are selected from the drive signal, whereby the small dot drive pulse DP1 is generated. Likewise, the third pulse signal PS13 is selected from the drive signal, whereby the medium dot drive pulse DP2 is generated. The fourth pulse signal PS14 and the seventh pulse signal PS17 are selected from the drive signal, whereby the large dot drive pulse DP3 is generated. The drive pulse DP1, DP2, or DP3 thus generated is supplied to the piezoelectric vibrator 15, whereby any desired amount of ink droplet can be ejected through the corresponding nozzle orifice 14.

Although not shown, the vibrating pulse is generated by selecting the first pulse signal PS11, the fourth pulse signal PS14, and the fifth pulse signal PS15 from the drive signal.

Next, the small dot drive pulse DP1 will be discussed in detail. It corresponds to a drive pulse of the invention.

Figure 8:
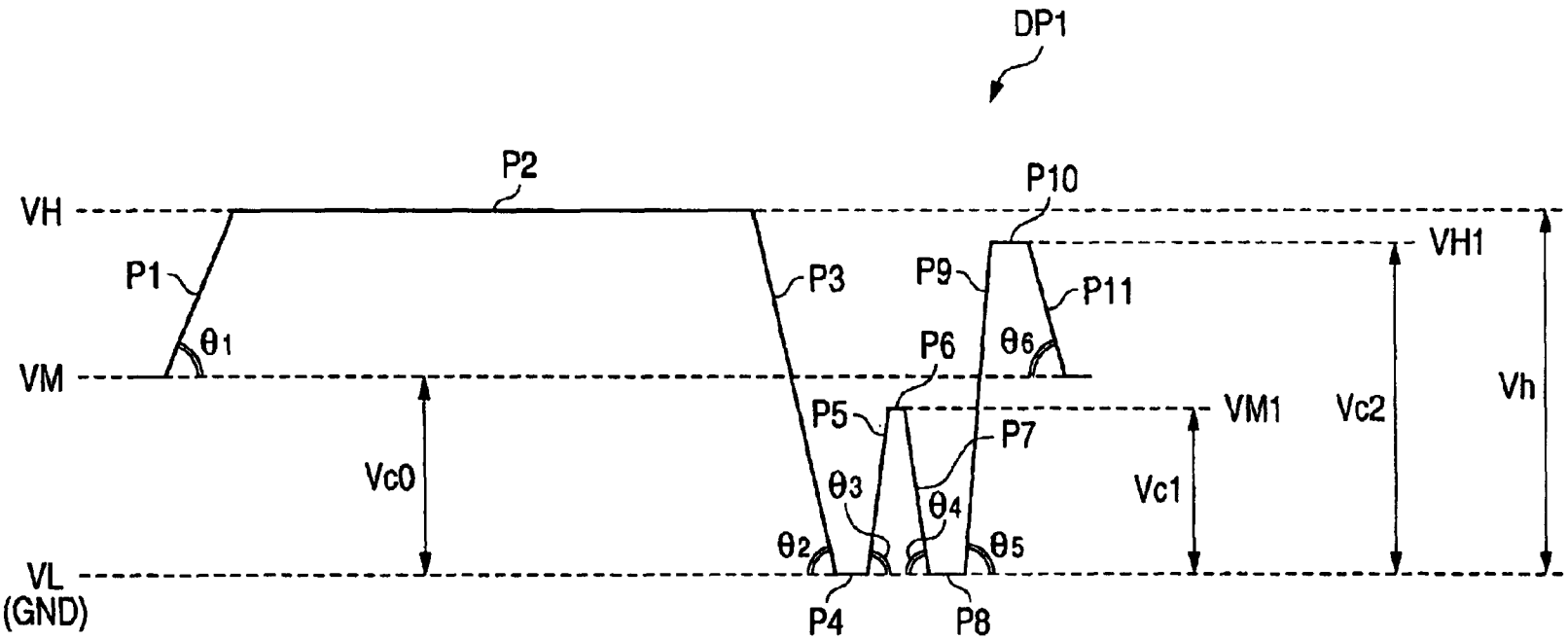
FIG. 8 is a time chart to show a small dot drive pulse, according to one embodiment of the invention.

As shown in FIG. 8, the small dot drive pulse DP1 is a signal comprising a first charge element P1 and a first hold element P2 serving as a preliminary contracting element of the invention, a first discharge element P3 serving as a first expanding element of the invention, a second hold element P4 serving as an expanded state holding element, a second charge element P5 serving as a first contracting element of the invention, a third hold element P6, a second discharge element P7 serving as a second expanding element of the invention, a fourth hold element P8, a third charge element P9 serving as a second contracting element of the invention, a fifth hold element P10 serving as a damping hold element of the invention, and a third discharge element P11 serving as a damping element of the invention. These elements of the small dot drive pulse DPI are generated in order.

The first charge element P1 raises the potential from medium potential (bias level) VM to the highest potential VH (corresponding to the start end potential of the first discharge element P3) with a gradient θ1. The supplying time period of the first charge element P1 in the this embodiment is set to 11 μsec roughly equal to the natural vibration period Tc of the pressure chamber 16, for example. When the first charge element P1 is supplied to the piezoelectric vibrator 15, the pressure chamber 16 is contracted relatively moderately from the reference volume associated with the medium potential VM to the minimum volume associated with the highest potential VH. As the first charge element P1 is supplied, the volume of the pressure chamber 16 is contracted, but an ink droplet is not ejected.

The medium potential VM is a potential defining the reference volume of the pressure chamber 16 and is determined based on the drive voltage Vh in the drive signal (potential difference between lowest potential VL and highest potential VH). In the embodiment, the medium potential VM is determined so that the potential difference from the lowest potential VL becomes Vc0. The potential difference Vc0 may be changed whenever necessary.

The first hold element P2 holds the highest potential VH of the termination potential of the first charge element P1 over a predetermined time period. This means that the pressure chamber 16 holds the minimum volume over the time period during which the first hold element P2 is supplied to the piezoelectric vibrator 15. Pressure fluctuation of ink in the pressure chamber 16 caused as the first charge element P1 is supplied is attenuated gradually during the supplying time period. The supplying time period of the first hold element P2 is set to a sufficient time for pressure fluctuation of ink to attenuate, for example, n times the natural vibration period Tc (n is a natural number).

Specifically, the supplying time period is set to 20 to 60 μsec corresponding to twice to six times the natural vibration period Tc.

The first discharge element P3 is a first expanding element for dropping the potential from the highest potential VH to the lowest potential VL with a steep gradient θ2 to such an extent that an ink droplet is not ejected. As the first discharge element P3 is supplied to the piezoelectric vibrator 15, the pressure chamber 16 is expanded rapidly from the above-mentioned minimum volume to the maximum volume associated with the lowest potential VL (first expanding step). As the pressure chamber 16 is expanded, the inside thereof is decompressed and a meniscus (free surface of ink exposed on the nozzle orifice 14) is largely pulled into the side of the pressure chamber 16. That is, at the time, the meniscus is largely pulled into the side of the pressure chamber 16 at the maximum.

The first discharge element P3 is a waveform element for pulling in a meniscus at the maximum and thus is set to the drive voltage and supplying time period for making full use of the function. To efficiently pull in a meniscus, preferably the supplying time period (namely, first expanding step execution time period) is set equal to or less than a half the natural vibration period Tc of the pressure chamber 16. Since the natural vibration period Tc is 10.0 μsec in the embodiment, preferably the supplying time period of the first discharge element P3 is set to 5.0 μsec or less. Thus, the supplying time period of the first discharge element P3 is set to 4.0 μsec.

The supplying time period is not limited to 4.0 μsec if a meniscus can be largely pulled into the side of the pressure chamber; for example, the supplying time period may be set to 3.5 μsec.

In the embodiment, before the first discharge element P3 is supplied, the first charge element P1 and the first hold element P2 (namely, preliminary contracting elements) are supplied for contracting the pressure chamber 16 from the reference volume to the minimum volume before a meniscus is largely pulled in (preliminary contracting step). In doing so, the degree of volume change of the pressure chamber 16 when a meniscus is pulled in can be increased and the meniscus can be largely pulled into the side of the pressure chamber.

According to the first charge element P1 and the first hold element P2, the drive voltage of the first discharge element P3 is set from the highest potential VH to the lowest potential VL, namely, is set to the drive voltage Vh of the drive signal; the drive voltage of the first discharge element P3 is set to a large value as much as possible.

The second hold element P4 is an element for holding the lowest potential VL of the termination potential of the first discharge element P3 over a predetermined time period, in order words, is an element for connecting the termination of the first discharge element P3 and the start end of the second charge element P5 at the same potential. The second hold element P4 defines the supply start timing of the second charge element P5 supplied following the second hold element P4. In the embodiment, the supplying time period of the second hold element P4 is set to 2.0 μsec.

Figure 9A:
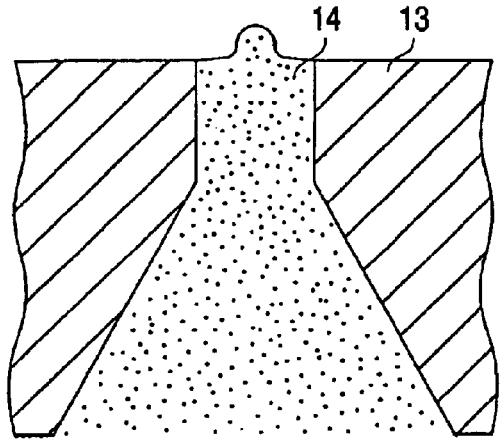
FIGS. 9A to 9C are schematic drawings to describe the motion of a meniscus when the small dot drive pulse is supplied.

The second charge element P5 is a first contracting element for raising the potential from the lowest potential VL to a second hold potential VM1 with a steep gradient θ3. When the second charge element P5 is supplied to the piezoelectric vibrator 15, the pressure chamber 16 is contracted and the inside thereof is pressurized (first contracting step). At the termination end of the second charge element P5, a meniscus is positioned in the vicinity of an opening margin of the nozzle orifice 14 and the center of the meniscus is swelled toward the ink droplet ejecting direction from the marginal portion thereof, as shown in FIG. 9A.

The second charge element P5 is a waveform element for swelling the center of the meniscus and thus is set to the supplying time period (execution time period of first contracting step) and the drive voltage for making it possible to swell the center of the meniscus. From this viewpoint, preferably the supplying time period of the second charge element P5 is set equal to or less than one quarter the natural vibration period Tc of the pressure chamber 16; in the embodiment, the supplying time period is set to 1.6 μsec. The drive voltage Vc1 of the second charge element P5, namely, the potential difference between the lowest potential VL and the second hold potential VM1 is set to 50% of the above-mentioned drive voltage Vh.

The drive voltage Vc1 can be thus set low, because the supplying time period of the first discharge element P3 is set equal to or less than a half the natural vibration period Tc for largely pulling in the meniscus. That is, ink in the pressure chamber is pressurized using the reaction of pulling in accompanying supply of the first discharge element P3 and thus necessary pressure can be provided if the drive voltage Vc1 is set low. This can reduce the mechanical and electrical loads on the piezoelectric vibrator and also contributes to stable ejecting of an ink droplet and prolonging the life of the piezoelectric vibrator.

The value of the second hold potential VM1, in other words, the drive voltage Vc1 of the second charge element P5 is set appropriately in response to the first discharge element P3. From the viewpoint of matching the termination potential of the first discharge element P3 with the start end potential of the third charge element P9 (described later), preferably the drive voltage Vc1 is set to 60% or less of the drive voltage Vh in the drive signal COM and more preferably is set to 50% or less of the drive voltage Vh.

To efficiently use the reaction of pulling in mentioned above, the supply start timing of the second charge element P5 becomes important. That is, preferably supply of the second charge element P5 is started at the timing at which the meniscus pulled in by the first discharge element P3 moves in an ejecting direction of the ink drop.

Likewise, to efficiently use the reaction of pulling in, preferably the supplying time period of the second hold element P4 is set so that the sum of the supplying time period of the second hold element P4 and that of the first discharge element P3 falls within a range of ¼ Tc to ¾ Tc. In the embodiment, the supplying time period of the second hold element P4 is set to 2.0 μsec as mentioned above, and thus the sum of the supplying time period of the second hold element P4 and that of the first discharge element P3 becomes 6.0 μsec, which is within the range of ¼ Tc (2.5 μsec) to ¾ Tc (7.5 μsec).

The third hold element P6 holds the second hold potential VM1 of the termination potential of the second charge element P5 for a predetermined time period. In other words, it connects the termination of the second charge element P5 and the start end of the second discharge element P7 at the same potential.

The third hold element P6 is a pressurizing hold element for defining the supply start timing of the second discharge element P7 supplied following the third hold element P6. From the viewpoint of stably ejecting a minute ink droplet, preferably the supplying time period of the third hold element P6 (contracted state holding time period) is set equal to or less than a quarter the natural vibration period Tc of the pressure chamber 16. Specifically, preferably the supplying time period is 3.0 μsec or less and more preferably 1.0 μsec or less. In short, preferably the supplying time period is set to a value close to zero as much as possible. Then, in the embodiment, the supplying time period of the third hold element P6 is set to 0.8 μsec.

The second discharge element P7 is an expanding element for dropping the potential from the second hold potential VM1 to the lowest potential VL with a steep gradient θ4. When the second discharge element P7 is supplied to the piezoelectric vibrator 15, the pressure chamber 16 is expanded and the inside thereof is decompressed (second expanding step). The second discharge element P7 is supplied at the timing at which the center of the meniscus swells and forming the tip of an ink droplet is started as shown in FIG. 9A.

Figure 9B:
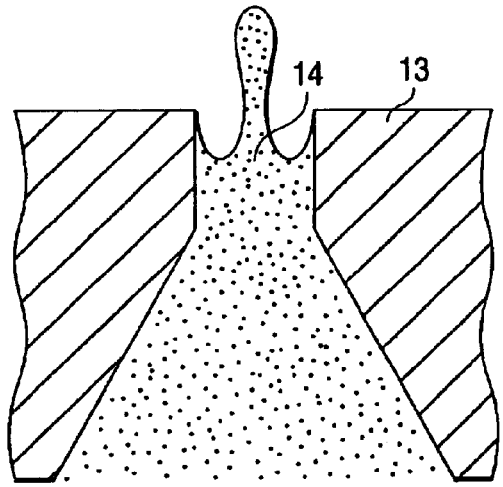

As the second discharge element P7 is supplied, the pressure chamber 16 is expanded and as the pressure chamber 16 is expanded, the marginal portion of the meniscus is pulled into the side of the pressure chamber 16. On the other hand, as the pressure chamber 16 is expanded, the center of the meniscus is not pulled in. Consequently, an ink pillar extended like a pillar is formed in the center of the meniscus at the termination time of supplying the second discharge element P7, as shown in FIG. 9B.

It is considered that this phenomenon is observed because the meniscus causes high-order vibration as the steep second discharge element P7 is supplied. That is, it is considered that a vibration mode (third-order vibration mode) for largely changing the moving speed of the marginal portion of the meniscus in an opposite direction to the ink droplet ejecting direction is excited without much changing the moving speed of the center of the meniscus as the second discharge element P7 is supplied.

To excite such a vibration mode, the supplying time period (second expanding step execution time period) and the drive voltage of the second discharge element P7 are important. Preferable, the supplying time period is set equal to or less than a quarter the natural vibration period Tc of the pressure chamber 16; in the embodiment, it is set to 1.0 μsec. The drive voltage is set to 50% of the drive voltage Vh in the drive signal. That is, the drive voltage of the second discharge element P7 is also set to the drive voltage Vc1 like that of the second charge element P5.

To lessen the amount of an ink droplet, preferably the drive voltage and the supplying time period of the second discharge element P7 are determined so that the expansion speed of the pressure chamber 16 with supply of the second discharge element P7 becomes higher than the contracting speed of the pressure chamber 16 with supply of the second charge element P5.

The timing of starting to supply the second discharge element P7 is important in the point of lessening the amount of an ink droplet. If supply of the second discharge element P7 is started between the instant at which the center of the meniscus swells and the instant at which the moving speed average at the root portion of the ink pillar becomes roughly zero, it is considered that the advantage of lessening the amount of an ink droplet can be provided.

Since the drive voltage Vc1 of the second charge element P5 can be set relatively low as mentioned above, if the drive voltage of the second discharge element P7 is set low, the termination potential of the second discharge element P7 can be matched with the termination potential of the first discharge element P3. Accordingly, the start end potential of the third charge element P9 supplied following the second discharge element P7 can be set low and if the drive voltage of the third charge element P9 is set large, the drive voltage Vh of the drive signal can be placed in a proper voltage value.

From this viewpoint, preferably the drive voltage of the second discharge element P7 is set equal to or less than the drive voltage of the second charge element P5 and more preferably the former is set to the same voltage as or a slightly lower voltage than the latter. For example, if the drive voltage Vc1 of the second charge element P5 is set to 60% of the drive voltage Vh, preferably the drive voltage of the second discharge element P7 falls within a range of 50% to 60% of the drive voltage Vh. If the drive voltage Vc1 is set to 50% of the drive voltage Vh, preferably the drive voltage of the second discharge element P7 falls within a range of 40% to 50% of the drive voltage Vh. In other words, preferably the drive voltage of the second discharge element P7 is set so that the termination potential of the second discharge element P7 is placed within the range of 10% of the drive voltage Vh from the termination potential of the first discharge element P3 toward the side of the medium potential VM.

When the first discharge element P3, the second charge element P5, and the second discharge element P7 described above are supplied to the piezoelectric vibrator 15, the ink amount of the ink pillar mentioned above can be lessened extremely and consequently the ejected ink droplet amount can be reduced.

The fourth hold element P8 is an element for holding the lowest potential VL of the termination potential of the second discharge element P7 over a predetermined time period, and the supplying time period of the fourth hold element P8 is set to 1.2 μsec, for example. The fourth hold element P8 defines the supply start timing of the third charge element P9 supplied following the fourth hold element P8.

The third charge element P9 is a second contracting element for raising the potential from the lowest potential VL to the third hold potential VH1 with a gradient θ5. When the third charge element P9 is supplied to the piezoelectric vibrator 15, the pressure chamber 16 is contracted relatively largely (second contracting step). As the pressure chamber 16 is contracted, ink is pressurized, a meniscus moves in the ink droplet ejecting direction, and an ink pillar formed in the center of the meniscus is pushed out in the ink ejecting direction.

Figure 9C:
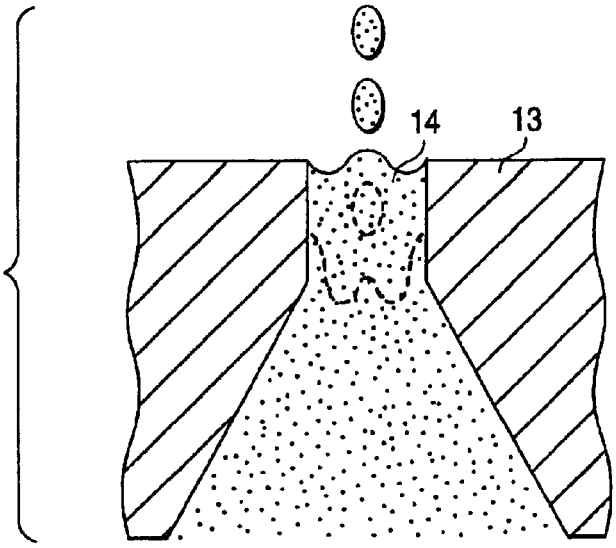

That is, at the termination time of supplying the third charge element P9, as shown in FIG. 9C, the meniscus is pushed out to the vicinity of the opening margin of the nozzle orifice 14 and in this state, the ink pillar is torn off and is separated into a main ink droplet and a satellite ink droplet associated with the main ink droplet and the main ink droplet and the satellite ink droplet are jetted. That is, the satellite ink droplet is jetted so as to follow the main ink droplet.

In this case, if the ink amount of the small dot is about 4 pL, the amount of the main ink droplet becomes about 2 pL and the amount of the satellite ink droplet also becomes about 2 pL. The jetting speed of the satellite ink droplet is raised to 4.5 to 6.0 m/s because the pushing-out force acts on the ink pillar. As the jetting speed of the satellite ink droplet is increased, the landing time difference between the main ink droplet and the satellite ink droplet can be lessened. Consequently, degradation of the print quality caused by the landing time difference between the main ink droplet and the satellite ink droplet can be suppressed and the image quality can be improved.

Since the jetting speed of the satellite ink droplet is increased, the deviated flight of the satellite ink droplet when pigment ink is ejected can also be suppressed. Consequently, the print quality can also be improved in pigment ink generally regarded as having poor stability of the jetting direction.

Further, since the meniscus is pushed out to the vicinity of the opening margin of the nozzle orifice 14, the ink amount of the satellite ink droplet can also be lessened still more. It is considered that the effect is produced due to the surface tension of ink. That is, it is considered that if the ink pillar is torn out with the meniscus pushed out, more ink can be taken into the meniscus side.

If the ink amount of the satellite ink droplet can be lessened, the ink droplet amount, namely, the total amount of the main ink droplet and the satellite ink droplet also lessens and the dot diameter can be made small, contributing to high image quality.

If the third charge element P9 is not used, the meniscus is positioned to the depth (pressure chamber 16 side) of the nozzle orifice 14 at the timing at which the ink pillar is torn out as indicated by the dotted line in FIG. 9C. In this case, the jetting speed of the satellite ink droplet becomes about 3 to 4 m/s. Since the ink pillar is torn out in a long extension state, the main ink droplet and the satellite ink droplet jet apart from each other. Thus, there is probability that the landing position of the main ink droplet may shift largely from that of the satellite ink droplet.

By the way, in the embodiment, the first discharge element P3, the second charge element P5, and the second discharge element P7 are set as mentioned above, so that the termination potential of the second discharge element P7, namely, the start end potential of the third charge element P9 can be matched with the termination potential of the first discharge element P3. Specifically, the start end potential of the third charge element P9 can be set to the lowest potential VL. Accordingly, if the drive voltage Vc2 of the third charge element P9 is set large, the termination potential of the third charge element P9 can be placed equal to or less than a predetermined potential, for example, can be made lower than the highest potential VH.

The supplying time period (execution time period of second contracting step) and the drive voltage Vc2 (potential difference between lowest potential VL of start end potential and third hold potential VH1 of termination potential) of the third charge element P9 have an effect on the ink pillar pushing-out force mentioned above. That is, if the supplying time period is set short and the drive voltage Vc2 is set large, the pressure chamber 16 is largely contracted in a short time, so that the ink pillar pushing-out force becomes relatively large. In contrast, if the supplying time period is set long and the drive voltage Vc2 is set small, the pressure chamber 16 is largely contracted in a short time, so that the ink pillar pushing-out force becomes relatively small.

To efficiently push out the ink pillar, preferably the supplying time period of the third charge element P9 is set equal to or less than one third the natural vibration period Tc of the pressure chamber 16. In the embodiment, based on the concept, the supplying time period of the third charge element P9 is set to 1.6 μsec.

The drive voltage Vc2 of the third charge element P9 can be set appropriately in the range in which the jetting speed of the satellite ink droplet is increased. For example, the drive voltage Vc2 may be set to 70% or 90% of the drive voltage Vh; preferably it is 75% or more of the drive voltage Vh. In the embodiment, the drive voltage Vc2 is set to 75% of the drive voltage Vh. If the drive voltage Vc2 is set large to such an extent, the ink pillar can be pushed out in the ink droplet ejecting direction by a relatively strong force as the third charge element P9 is supplied. From the viewpoint of not setting the drive voltage Vh excessively high, preferably the termination potential of the third charge element P9 is set so as not to exceed the start end potential of the first discharge element P3.

From the viewpoint of pushing out the ink pillar, the start timing of supplying the third charge element P9 is also important, because if contracting the pressure chamber 16 is placed out of timing, behavior of ink is disordered, for example, and it becomes hard to provide any desired ejection characteristic. Considering this point, preferably the time interval between the supply start timing of the second charge element P5 and that of the third charge element P9, namely, the time interval between the start end of the second charge element P5 and that of the third charge element P9 is set equal to or less than the natural vibration period Tc of the pressure chamber 16 and more preferably is set within the range of one quarter to three quarters the natural vibration period Tc. In the embodiment, the time interval is set to 4.6 μsec.

The fifth hold element P10 is an element for holding the third hold potential VH1 of the termination potential of the third charge element P9 over a predetermined time period, in other words, an element for connecting the termination of the third charge element P9 and the start end of the third discharge element P11 at the third hold potential VH1. The fifth hold element P10 is a damping hold element for defining the supply start timing of the third discharge element P11 supplied following the fifth hold element P10, and the supplying time period of the fifth hold element P10 is set to 1.8 μsec. When the fifth hold element P10 is supplied to the piezoelectric vibrator 15, the operation of contracting the pressure chamber 16 by the third charge element P9 is stopped.

The third discharge element P11 drops the potential from the third hold potential VH1 to the medium potential VM with a gradient θ6. When the third discharge element P11 is supplied to the piezoelectric vibrator 15, the pressure chamber 16 is expanded to the reference volume. The start timing of expanding the pressure chamber 16 is defined based on the supplying time period of the fifth hold element P10 and is set to a timing at which relatively large vibration of a meniscus just after an ink droplet is ejected can be canceled. That is, the pressure chamber 16 is expanded at the timing at which opposite-phase vibration to motion of the meniscus can be provided. Therefore, the third discharge element P11 acting in such a manner serves as a damping element.

The supply start timing of the third discharge element P11 is defined by the elapsed time since the supply start timing of the second charge element P5. That is, preferably the time interval between the start end of the second charge element P5 and that of the third discharge element P11 is set equal to or less than the natural vibration period Tc of the pressure chamber 16. In the embodiment, the time interval is set to 8.0 μsec because the supplying time period of the fifth hold element P10 is set to 1.8 μsec.

The supplying time period of the third discharge element P11 defines the expansion speed of the pressure chamber 16 and thus is important from the viewpoint of efficiently attenuating vibration of the meniscus after an ink droplet is ejected. Preferably, the supplying time period of the third discharge element P11 is set equal to or less than a half the natural vibration period Tc of the pressure chamber 16. In the embodiment, the supplying time period of the third discharge element P11 is set to 1.6 μsec so as to satisfy the condition.

As described above, if the small dot drive pulse DP1 is supplied to the piezoelectric vibrator 15, the inside of the pressure chamber 16 is rapidly decompressed by the first discharge element P3 and the meniscus is largely pulled into the pressure chamber side. After the termination of decompressing the pressure chamber 16, the pressure chamber 16 is a little pressurized by the second charge element P5. After the termination of pressuring the pressure chamber 16, the pressure chamber 16 is again decompressed by the second discharge element P7. After the termination of again decompressing the pressure chamber 16, the pressure chamber 16 is pressurized by the third charge element P9.

In this operation sequence, as the first discharge element P3 and the second charge element P5 are supplied, a projection is formed in the center of the meniscus and a pulling force into the side of the pressure chamber 16 as the second discharge element P7 is supplied is made to act, whereby the marginal portion of the meniscus is pulled toward the pressure chamber 16. This makes it possible to eject an extremely small amount of ink droplet. Further, the generated ink pillar is pushed out in the ink ejecting direction by pressurizing the pressure chamber 16 as the third charge element P9 is supplied. Accordingly, the root portion of the ink pillar (the portion of the meniscus side) is urged in the ink ejecting direction and thus when the ink pillar is torn off and is separated into a main ink droplet and a satellite ink droplet so that the jetting speed of the satellite ink droplet can be increased. Consequently, the landing position of the main ink droplet can be matched with that of the satellite ink droplet and the image quality can be improved.

Next, a procedure of selecting each pulse signal and recording in multiple gradation steps will be discussed briefly.

The decoder 45 generates 10-bit pulse selection data corresponding to recording data (gradation information). The bits of the pulse selection data correspond to the pulse signals and the connection elements. That is, the most significant bit of the pulse selection data corresponds to the first pulse signal PS11 at time T1, the second-most significant bit corresponds to the second pulse signal PS12 at time T2, and the third-most significant bit corresponds to the first connection element CP1 at time TS1. Likewise, the pulse selection data bits of the fourth-most significant bit to the least significant bit (seventh pulse signal PS17 at time T7) correspond to the pulse signals and the connection elements. The decoder 45 sets data "0" in the bits corresponding to the connection elements CP1 to CP3.

If the most significant bit of the pulse selection data is "1," the switcher 48 enters a connection state from the first timing signal generated at the start end of the time T1 corresponding to an LAT signal to the second timing signal generated at the start end of the time T2 corresponding to the first CH signal. Accordingly, the first pulse signal PS11 is selected from the drive signal COM and is supplied to the piezoelectric vibrator 15. Likewise, if the second-most significant bit is "1," the switcher 48 enters a connection state from the second timing signal to the third timing signal generated at the start end of the time TS1 corresponding to the second CH signal. Accordingly, the second pulse signal PS12 is selected from the drive signal and is supplied to the piezoelectric vibrator 15. Likewise, if the third-most significant bit or the later is "1," the corresponding pulse signal is supplied.

The decoder 45 generates pulse selection data (0100000100) by translating recording data for a small dot (gradation information 01), as shown in FIG. 7. Likewise, the decoder 45 generates pulse selection data (0001000000) by translating recording data for a medium dot (gradation information 10) and generates pulse selection data (0000100001) by translating recording data for a large dot (gradation information 11).

Accordingly, based on the recording data of the small dot, the second pulse signal PS12 and the sixth pulse signal PS16 are supplied to the corresponding piezoelectric vibrator 15. This means that the small dot drive pulse DP1 is supplied to the piezoelectric vibrator 15. Based on the recording data of the medium dot, only the third pulse signal PS13 is supplied to the corresponding piezoelectric vibrator 15. This means that the medium dot drive pulse DP2 is supplied to the piezoelectric vibrator 15. Likewise, based on the recording data of the large dot, the fourth pulse signal PS14 and the seventh pulse signal PS17 are supplied to the corresponding piezoelectric vibrator 15. This means that the large dot drive pulse DP3 is supplied to the piezoelectric vibrator 15. That is, the pulse supplier selectively supplies a pulse signal to the piezoelectric vibrator in response to the amount of an ink droplet ejected through the nozzle orifice.

Figure 10:
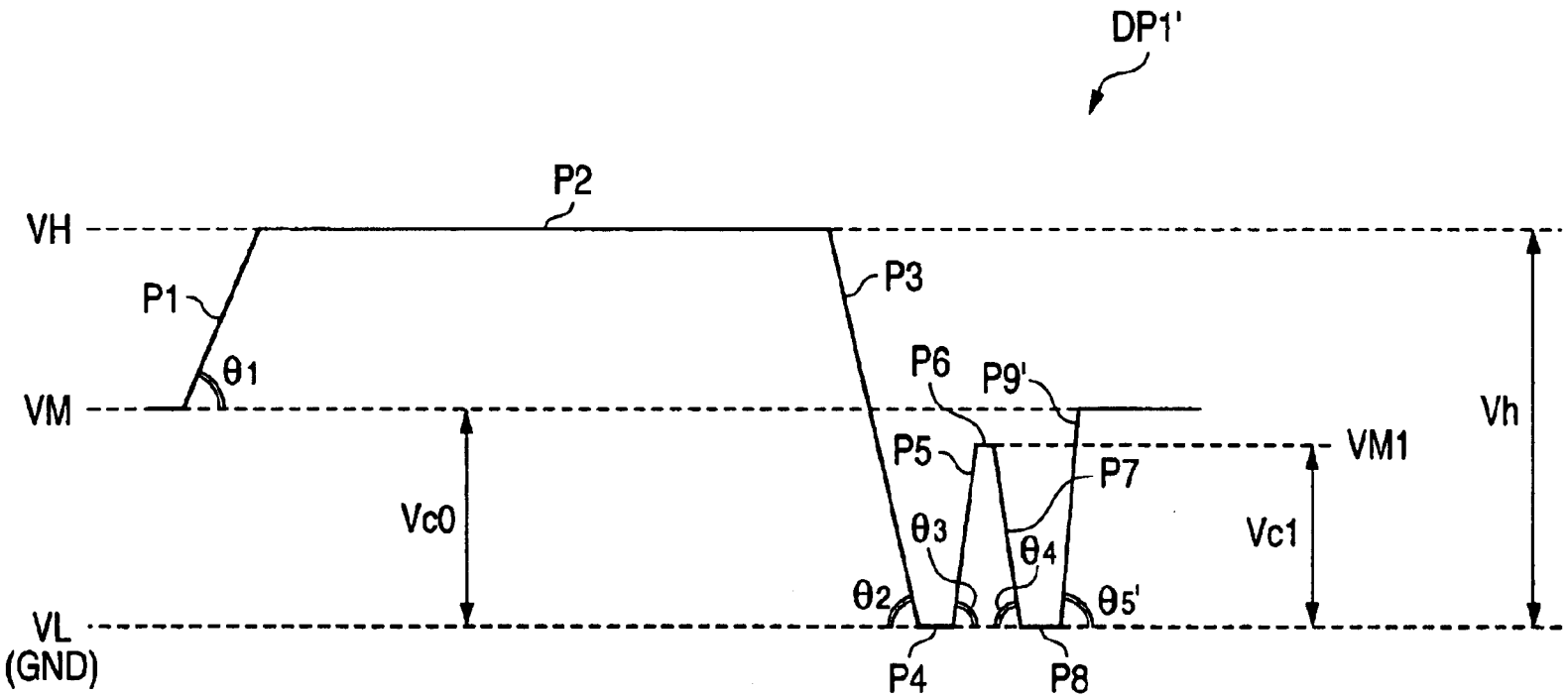
FIG. 10 is a time chart to show a small dot drive pulse according to another embodiment of the invention.

The embodiment is illustrative and not restrictive, since the scope of the invention is defined by the appended claims, and all changes that fall within meets and bounds of the claims, or equivalence of such meets and bounds are therefore intended to embraced by the claims. For example, the jetting speed of a satellite ink droplet can also be increased to some extent in a modified example of small dot drive pulse as shown in FIG. 10.

A small dot drive pulse DP1' in the modified example differs from the above-described small dot drive pulse DP1 in third charge element P9, fifth hold element P10, and third discharge element P11, and they are the same in other waveform elements. Waveform elements identical with those previously described with reference to FIG. 8 are denoted by the same symbols in FIG. 10.

In the small dot drive pulse DP1', a third charge element P9' raises the potential from the lowest potential VL of the start end potential to the medium potential VM of the termination potential with a gradient θ5' for contracting the pressure chamber 16 from the volume defined by the lowest potential VL to the reference volume defined by the medium potential VM. Thus, the fifth hold element P10 and the third discharge element P11 in the above-described small dot drive pulse DP1 are eliminated from the drive pulse DP1'.

In the small dot drive pulse DP1', the third charge element P9' acts so as to push out an ink pillar in the ink ejecting direction. Therefore, the jetting speed of a satellite ink droplet jetted in association with jetting of a minute ink droplet as a main ink droplet can be increased to some extent as the third charge element P9' is supplied.

By the way, in the above embodiments, the printer 1 having the recording head 2 comprising the piezoelectric vibrators 15 in the deflection vibration mode has been described by way of example, but the invention can also be applied to a printer 1 having a recording head 2 comprising piezoelectric vibrators in so-called vertical vibration mode. Each piezoelectric vibrator in the vertical vibration mode expands the corresponding pressure chamber 16 as deformation based on charging and contracts the corresponding pressure chamber 16 as deformation based on discharging. A recording head may be used wherein the volume of each pressure chamber 16 is changed by a magnetostrictor rather than the piezoelectric vibrator for causing pressure fluctuation to occur in ink.

Further, the invention can be applied to not only the printer 1, but also to ink jet recording apparatuses such as a plotter and a facsimile. It can also be applied to a jetting apparatus for jetting liquid of glue, manicure, etc., through each nozzle orifice and a manufacturing apparatus for coloring an optical filter.

What is claimed is:

1. A liquid jetting apparatus, comprising:

a liquid jetting head, including a nozzle orifice, a pressure chamber communicated with the nozzle orifice, and a pressure generating element which varies, the volume of the pressure chamber; and a drive signal generator, which generates a drive signal including a drive pulse, supplied to the pressure generating element, the drive pulse including:

a first expanding element, which drives the pressure generating element so as to expand the pressure chamber, so that a meniscus of liquid in the nozzle orifice is pulled toward the pressure chamber as much as possible;

a first contracting element, which drives the pressure generating element so as to contract the pressure chamber expanded by the first expanding element, so that a center portion of the meniscus is swelled in an ejecting direction of a liquid drop;

a second expanding element, which drives the pressure generating element so as to expand the pressure chamber contracted by the first contracting element, so that a marginal portion of the swelled center portion of the meniscus is pulled toward the pressure chamber; and a second contracting element, which drives the pressure generating element so as to contract the pressure chamber expanded by the second expanding element, so that the meniscus is again urged in the ejecting direction to increase jetting speed of a satellite liquid drop which follows a main liquid drops, wherein a contracted amount of the pressure chamber established by the second contracting element is larger than at least one of a contracted amount of the pressure chamber established by the first contracting element and an expanded amount of the pressure chamber established by the second expanding element; and wherein the contracted amount of the pressure chamber established by the second contracting element is less than an expanded amount of the pressure chamber established by the first expanding element.

2. The liquid jetting apparatus as set forth in claim 1, wherein a potential difference of the first expanding element is equal to the potential difference of the drive signal.

3. The liquid jetting apparatus as set forth in claim 1, wherein the potential difference of the first contracting element is not greater than 50% of the potential the drive signal; and wherein a potential difference of the second expanding element is not less than 40% of the potential difference of the drive signal.

4. The liquid jetting apparatus as set forth in claim 3, wherein the potential difference of the second expanding element is not greater than the potential difference of the first contracting element.

5. The liquid jetting apparatus as set forth in claim 1, wherein the second expanding element is supplied for a time period which is not greater than one quarter the natural vibration period of the pressure chamber.

6. The liquid jetting apparatus as set forth in claim 1, wherein a gradient of the second expanding element is greater than a gradient of the first contracting element.

7. The liquid jetting apparatus as set forth in claim 1, wherein a potential difference of the second contracting element is not less than 75% of the potential difference of the drive signal.

8. The liquid jetting apparatus as set forth in claim 1, wherein the drive pulse includes: a damping hold element, which holds a termination end potential of the second contracting element for a predetermined time period; and a damping element, supplied after the damping holding element to drive the pressure generating element so as to expand the pressure chamber to a reference volume thereof.

9. The liquid jetting apparatus as set forth in claim 8, wherein the damping element is supplied for a time period which is not greater than a half the natural vibration period of the pressure chamber.

10. The liquid jetting apparatus as set forth in claim 8, wherein a time period from a start end of the first contacting element to a start end of the damping element is not greater than the natural vibration period of the pressure chamber.

11. The liquid jetting apparatus as set forth in claim 1, wherein the drive pulse includes a preliminary contracting element, which drives the pressure generating element so as to contract the pressure chamber from a reference volume thereof, before the first expanding element is supplied.

12. The liquid jetting apparatus as set forth in claim 1, wherein the first expanding element is supplied for a time period which is not greater than a half a natural vibration period of the pressure chamber.

13. The liquid jetting apparatus as set forth in claim 1, wherein the second contracting element is supplied for a time period which is not greater than one third of a natural vibration period of the pressure chamber.

14. The liquid jetting apparatus as set forth in claim 1, wherein a time period between an initial end of the first contracting element and an initial end of the second contracting element is not greater than a natural vibration period of the pressure chamber.

15. The liquid jetting apparatus as set forth in claim 14, wherein the time period between the initial ends of the first contracting element and the second contracting element falls within a range of one quarter to one third the natural vibration period of the pressure chamber.

16. A method of driving a liquid jetting apparatus provided with a liquid jetting head which includes a nozzle orifice, a pressure chamber communicated with the nozzle orifice, and a pressure generating element, the method comprising the steps of:

a first expanding step, for driving the pressure generating element so as to expand the pressure chamber, so that a meniscus of liquid in the nozzle orifice is pulled toward the pressure chamber as much as possible;

a first contracting step, for driving the pressure generating element so as to contract the pressure chamber expanded by the first expanding step, so that a center portion of the meniscus is swelled in an ejecting direction of a liquid drop;

a second expanding step, for driving the pressure generating element so as to expand the pressure chamber contracted by the first contracting step, so that a marginal portion of the swelled center portion of the meniscus is pulled toward the pressure chamber; and a second contracting step, for driving the pressure generating element so as to contract the pressure chamber expanded by the second expanding step, so that the meniscus is again urged in the ejecting direction to increase jetting speed of a satellite liquid drop which follows a main liquid drop, wherein a contracted amount of the pressure chamber in the second contracting step is larger than at least one of a contracted amount of the pressure chamber in the first contracting step and an expanded amount of the pressure chamber in the second expanding step; and wherein the contracted amount of the pressure chamber in the second contracting step is less than an expanded amount of the pressure chamber in the first expanding step.

17. The driving method as set forth in claim 16, wherein the first expanding step is performed for a time period which is not greater than a half a natural vibration period of the pressure chamber.

18. The driving method as set forth in claim 16, wherein the second contracting step is performed for a time period which is not greater than one third of a natural vibration period of the pressure chamber.

19. The driving method as set forth in claim 16, wherein a time period between a time at which the first contracting step is started and a time at which the second contracting step is started is not greater than a natural vibration period of the pressure chamber.

20. The driving method as set forth in claim 19, wherein the time period between the start timings of the first contracting step and the second contracting step falls within a range of one quarter to one third the natural vibration period of the pressure chamber.

* * * * *